US005499429A

United States Patent [19]

Higginbotham

[11] Patent Number: 5,499,429

[45] Date of Patent: Mar. 19, 1996

[54] PAGER CLIP HAVING APERTURE FOR FASTENING TO AN EXTERNAL ARTICLE

[75] Inventor: Sandra Higginbotham, Sunrise, Fla.

[73] Assignee: Motorola, Inc., Schaumburg, Ill.

[21] Appl. No.: 262,286

[22] Filed: Jun. 20, 1994

[51] Int. Cl.[6] ..... A44B 21/00; A45F 5/00

[52] U.S. Cl. ..... 24/3.11; 24/3.5; 24/3.12; 24/563; 224/269

[58] Field of Search ..... 2/319, 305; 224/252, 224/249, 269; 24/3 J, 3 R, 3 G, 3 H, 3 L, 3 M, 563, 67.9, 67.3, 67.7, 67.11

[56] References Cited

U.S. PATENT DOCUMENTS

| | | | |
|---|---|---|---|
| 730,566 | 6/1903 | Pilcher | 24/3 M |
| 4,638,530 | 1/1987 | Perry | 24/3.12 |
| 4,741,074 | 5/1988 | Budano, II et al. | 24/3.11 |
| 4,828,153 | 5/1989 | Guzik et al. | 224/269 |
| 4,830,244 | 5/1989 | Brannon | 224/269 |
| 4,915,279 | 4/1990 | Galbraith | 24/3 H |
| 5,016,326 | 5/1991 | Goldenberg | 24/3 J |
| 5,023,978 | 6/1991 | Thompson et al. | 24/3 L |
| 5,038,985 | 8/1991 | Chapin | 24/3 J |
| 5,097,997 | 3/1992 | Kipnis et al. | 24/3 J |
| 5,309,605 | 5/1994 | Sato | 24/563 |

*Primary Examiner*—Victor N. Sakran
*Attorney, Agent, or Firm*—Kelly A. Gardner

[57] ABSTRACT

A clip (405) for attaching a portable electronic device (400) to an external article (805) comprises a first end (415) for coupling the clip (405) to the portable electronic device (400) and a second end (422) having an aperture (425) formed therein. The external article (805) can be positioned through the aperture (425) to secure the portable electronic device (400) to the external article (805).

13 Claims, 3 Drawing Sheets

400

400

400

400

PAGER CLIP HAVING APERTURE FOR FASTENING TO AN EXTERNAL ARTICLE

FIELD OF THE INVENTION

This invention relates in general to pagers, and more specifically to pagers that include clips for fastening the pager to an external article.

BACKGROUND OF THE INVENTION

Selective call receivers, e.g., pagers, are portable receiving devices that are usually carried by a user so that the user can receive messages while away from a computer or telephone. For convenience, therefore, a pager often includes a clip that is used for attaching the pager to an article of clothing to prevent the loss of the pager. Conventional clips are usually designed for attachment to the user's belt, waist band, or reinforced pocket. However, business attire for women often does not include articles of clothing to which a pager clip can be easily or securely attached. For example, a dress or business suit might not have a pocket, belt, or waistband to which the pager can be secured through use of a conventional clip. Therefore, many users may opt not to carry a pager at all, which results in missed messages or messages that are not immediately received. If a user attempts to clip a pager to clothing for which the pager clip was not designed, the pager can be easily dislodged and lost.

Thus, what is needed is a pager clip that allows greater flexibility regarding the type of clothing to which the pager can be securely attached.

SUMMARY OF THE INVENTION

A clip for attaching a portable electronic device to an external article comprises a first end for coupling the clip to the portable electronic device and a second end having an aperture formed therein. The external article can be positioned through the aperture to secure the portable electronic device to the external article.

DESCRIPTION OF A PREFERRED EMBODIMENT

Figure 1:
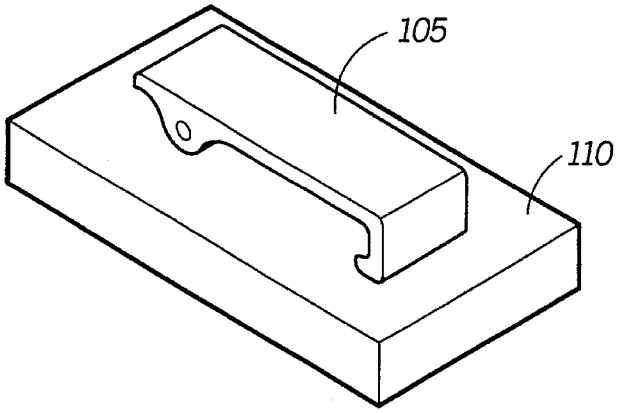
FIG.1 PRIOR ART
FIG. 1 is a perspective view of a pager including a conventional clip

FIG. 1 is a perspective view of a conventional selective call receiver, e.g., pager 100, for receiving and presenting selective call messages to a user. Typically, the pager 100 is designed to be portable so that a user can carry the pager 100 to receive messages while away from his computer and telephone. Therefore, the pager 100 includes a conventional belt clip 105 pivotally mounted to the back surface 110 of the pager 100. In this manner, the user can secure the pager 100 to an article of clothing, such as a belt or pocket, to prevent the loss of the pager 100.

Figure 2:
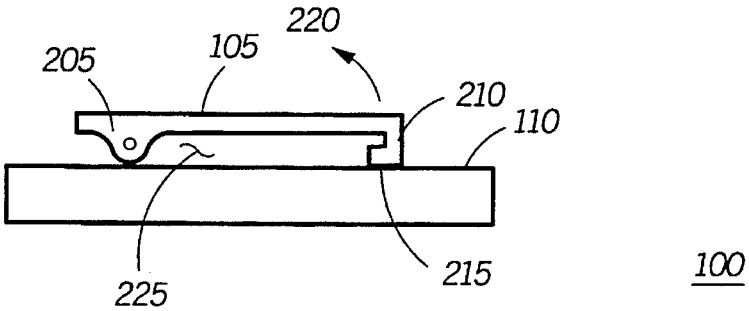
FIG.2 PRIOR ART
FIG. 2 is a side view of the conventional pager clip of FIG. 1.

Referring next to FIG. 2, a side view of the pager 100 is shown. As can be seen, the belt clip 105 includes a first end 205 for pivotally attaching the belt clip 105 to the pager 100. The belt clip 105 further includes a second end 210 which includes a contact surface 215 for contacting the back surface 110 of the pager 100. When a downwards force is exerted on the first end 205 of the belt clip 105, the clip 105 moves into an open position (not shown). More specifically, the second end 210 moves in a direction 220 to create a space between the contact surface 215 and the back surface 110 of the pager 100. An article of clothing can then be inserted between the back surface 110 and the belt clip 105. When the force is removed from the first end 205, the belt clip again rotates into the closed position shown in FIG. 2 to secure the article of clothing between the back surface 110 of the pager 100 and the belt clip 105, thereby securing the pager 100 to the article of clothing.

Figure 3:
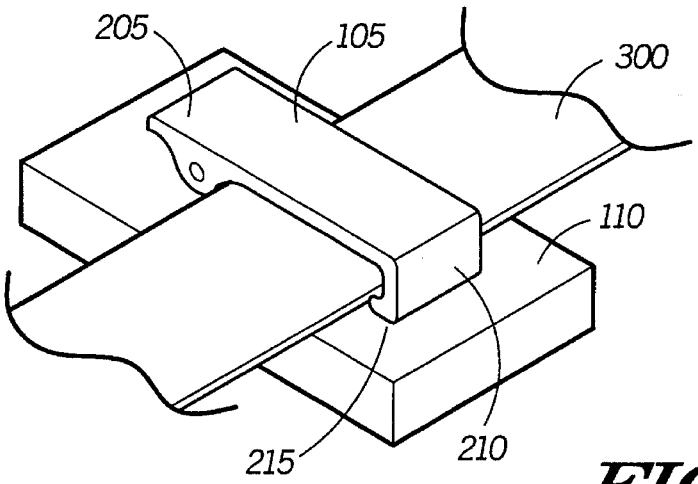
FIG.3 PRIOR ART
FIG. 3 is a perspective view of the pager of FIG. 1 when attached by the conventional clip of FIG. 1 to an external article.

FIG. 3 is a perspective view of the pager 100 when the pager 100 is secured to an article of clothing, such as a belt 300. As can be seen, when the belt clip 105 is in the closed position, the belt 300 is held within a space 225 (FIG. 2) created between the back surface 110 of the pager 100 and the belt clip 105. Therefore, the pager 100 can be carried by the user without being easily dislodged from the belt 300 and lost.

However, the conventional clip 105 mounted on the pager 100 is not suitable for attachment to some types of attire. For example, the pager 100 cannot be conveniently secured by the conventional clip 105 to clothing which does not include a belt, waistband, or pocket. Therefore, the pager 100 can be difficult to attach to clothing worn by women because such clothing often does not include belts, pockets, or other surfaces to which the clip 105 can be securely attached. In such a situation, a user carrying a pager 100 with a conventional clip 105 often carries the pager 100 by hand, creating a risk that the pager 100 will be misplaced, or leaves the pager 100 at a desk or other location to which the user will return, creating a risk that messages will not be received in a timely manner.

Figure 4:
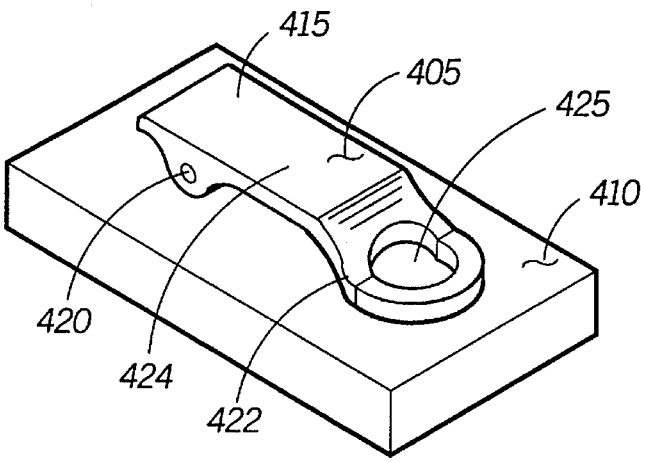
FIG. 4 is a perspective view of a portable electronic device, such as a pager, including a clip in accordance with the present invention.

FIG. 4 is a perspective view of a portable electronic device, such as a portable receiver, transmitter, or transceiver, meant to be carried by a user. For example, the portable electronic device can be a pager 400 for receiving signals from which information is recovered and presented to a user in a conventional manner. Because the pager 400 is intended to be carried by the user, the pager 400 includes a clip 405 for fastening the pager 400 to an external article, such as an article of clothing, in accordance with the present invention. As shown, the clip 405 is pivotally attached to a back surface 410 of the pager 400 at a first end 415. The clip 405 can be attached, for example, by a pin 420 that is inserted through the first end 415 of the clip 405 and through protrusions (not shown) formed on the back surface 410 of the pager 400. It will be appreciated that other methods of mounting the clip 405 to the pager 400 can also be utilized.

The clip 405 also includes a second end 422 coupled to the first end 415 by an elongated arm 424. According to the present invention, the second end 422 is formed in the shape of a loop through which an aperture 425 is formed for inserting an external article. It will be appreciated that, although the aperture 425 is depicted as circular in shape, a different shape, such as an ellipse, rectangle, or triangle, could be utilized alternatively. Preferably, a transition portion of the second end 422 slopes downward from the elongated arm 424 towards the back surface 410 of the pager 400, and a lower portion of the second end 422 forms a contact surface for contacting the back surface 410 of the pager 400, as may be better understood by referring to FIG. 5.

Figure 5:
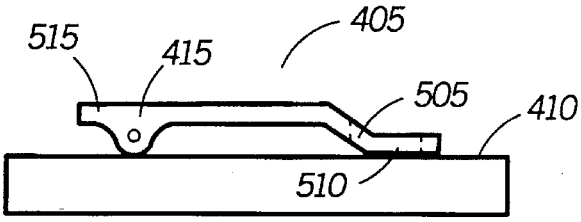
FIG. 5 is a side view of the clip of FIG. 4, in accordance with the present invention, when in a closed position.
Figure 6:
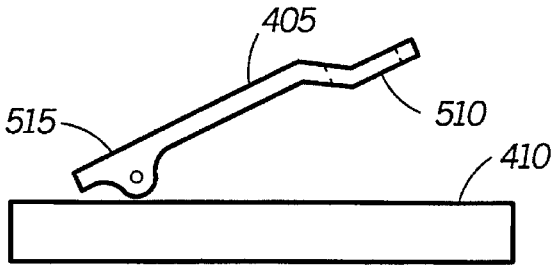
FIG. 6 is a side view of the clip of FIG. 4, in accordance with the present invention, when in an open position.

FIG. 5 is a side view of the pager 400 which shows the clip 405 in a closed position. As shown, the clip 405 is preferably mounted to the pager 400 such that the elongated arm 424 is held a small distance apart from the back surface 410 of the pager 400. The transition portion 505 of the second end 422 (FIG. 4) connects the elongated arm 424 to the lower portion of the second end 422 at which the contact surface 510 is formed. The clip 405 can be pivoted into an open position, as depicted in FIG. 6, by exerting a force on surface 515. When the clip 405 is in the open position, the contact surface 510 is removed from contact with the back surface 410 of the pager 400 such that an external article, such as a piece of clothing, can be inserted between the clip 405 and the back surface 410 of the pager 400 and held securely therebetween when the clip 405 is in the closed position (FIG. 5).

Figure 7:
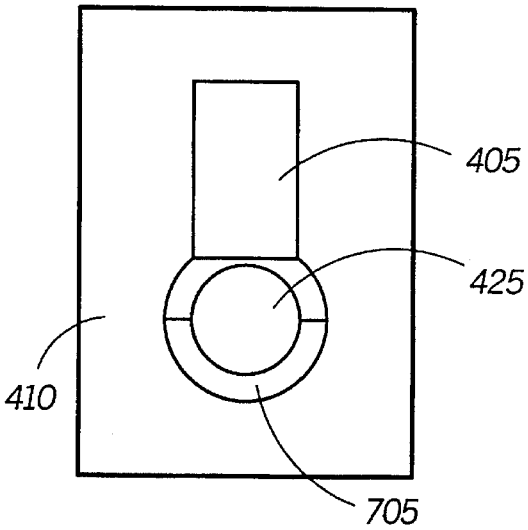
FIG. 7 is a top plan view of the pager and clip of FIG. 4 in accordance with the invention.

FIG. 7 is a top plan view of the pager 400 and the clip 405. As shown, the lower portion of the clip 405 that forms the contact surface 510 (FIG. 5) preferably has a greater surface area than that of the contact surface 215 (FIG. 2) of the conventional pager clip 105. As a result, pieces of clothing to which the conventional pager 100 (FIG. 2) cannot be securely fastened can be securely grasped by the clip 405 in accordance with the present invention. The conventional pager 100 cannot, for example, be easily worn by a user on his or her jacket lapel because the small contact surface 215 of the conventional clip 105 does not provide enough contact area to securely hold the pager 100 sideways or at a tilted angle. The clip 405 according to the present invention, however, is able to hold the weight of the pager 400 in positions other than an upright pocket position because the contact surface 510 contacts a greater surface area of the back surface 410 of the pager 400. As a result, the clip 405 can secure the pager 400 to articles of clothing to which the conventional pager 100 cannot be securely fastened.

Figure 8:
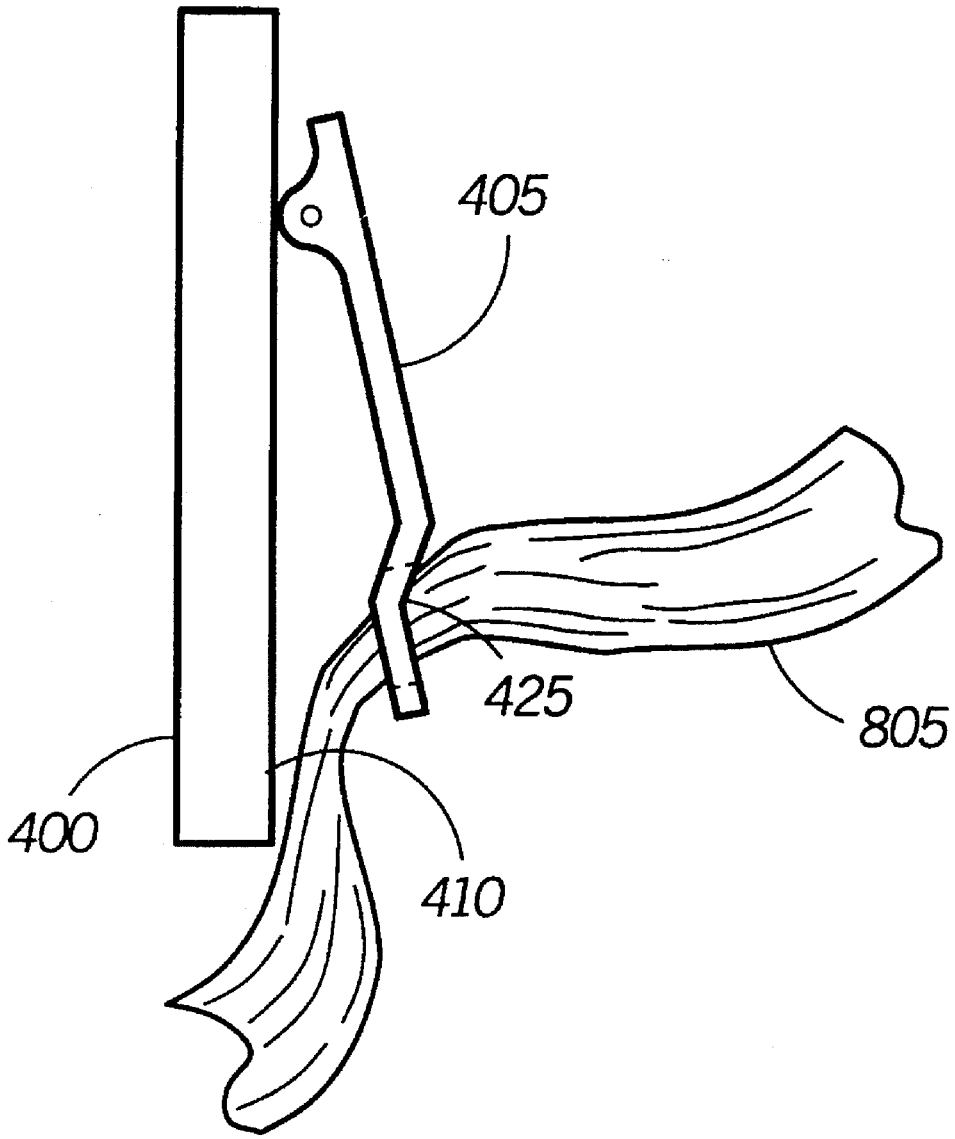
FIG. 8 is an illustration depicting the insertion of an external article through an aperture formed in the clip of FIG. 4 in accordance with the present invention.

Furthermore, as depicted in FIG. 8, an external article 805 can be conveniently positioned through the aperture 425 formed in the clip 405 to fasten the pager 400 to the external article 805. In this manner, the pager 400 can be securely worn on articles, such as scarves, necklaces, belt loops, pendants, or straps, to which the conventional pager 100 cannot be easily fastened.

In summary, the pager as described above advantageously utilizes a clip which can be fastened to articles of clothing such as scarves and lapels. As a result, the clip according to the present invention can be fastened to customary women's business attire to which conventional pagers cannot be securely attached. Because the pager can be easily and securely fastened to a diverse range of articles of clothing through use of the clip described above, situations are less likely to occur in which the pager is dislodged and lost or in which the user attempts to carry the pager by hand.

Thus, it will be appreciated that there has been provided a pager clip that is more flexible regarding the articles of clothing to which the pager can be fastened.

What is claimed is:

1. A clip for attaching a portable electronic device to an external article, the clip comprising:

a first end for coupling the clip to the portable electronic device;

a second end having an aperture formed therein and fully surrounded in a single plane thereby, wherein the external article can be positioned through the aperture to secure the portable electronic device to the external article;

mounting means coupled to the first end for pivotally attaching the first end of the clip to the portable electronic device such that the clip can be rotated between open and closed positions; and an elongated arm connecting the first and second ends;

wherein the second end includes a contact surface for contacting the portable electronic device when the clip is in the closed position and a transition portion which slopes toward the portable electronic device to connect the elongated arm and the contact surface.

2. The clip of claim 1, wherein, when the clip is in the open position, the external article can be inserted between the portable electronic device and the contact surface.

3. The clip of claim 2, wherein, when the external article has been inserted between the contact surface and the portable electronic device, the external article is held therebetween when the clip is in the closed position.

4. The clip of claim 3, wherein the second end of the clip is circular.

5. The clip of claim 4, wherein the aperture is circular.

6. A portable electronic device for receiving signals, the portable electronic device comprising:

a clip for attaching the portable electronic device to an external article, the clip comprising:

a first end for coupling the clip to the portable electronic device;

a second end having an aperture formed therein and fully surrounded in a single plane thereby, wherein the external article can be positioned through the aperture to secure the portable electronic device to the external article;

mounting means coupled to the first end for pivotally attaching the first end of the clip to the portable electronic device such that the clip can be rotated between open and closed positions; and an elongated arm connecting the first and second ends;

wherein the second end includes a contact surface for contacting the portable electronic device when the clip is in the closed position and a transition portion which slopes toward the portable electronic device to connect the elongated arm and the contact surface.

7. The portable electronic device of claim 6, wherein, when the clip is in the open position, the external article can be inserted between the portable electronic device and the contact surface.

8. The portable electronic device of claim 7, wherein, when the external article has been inserted between the contact surface and the portable electronic device, the external article is held therebetween when the clip is in the closed position.

9. The portable electronic device of claim 8, wherein the second end of the clip is circular.

10. The portable electronic device of claim 9, wherein the aperture is circular.

11. A portable receiver for receiving signals, the portable receiver comprising:

a clip for attaching the portable receiver to an external article, the clip comprising:

a first end for coupling the clip to the portable receiver;

a second end having an aperture formed therein and fully surrounded in a single plane thereby, wherein the external article can be positioned through the aperture to secure the portable receiver to the external article;

an elongated arm for connecting the first and second ends; and wherein the second end comprises:

a contact surface for contacting the portable receiver such that the external article can be held between the portable receiver and the contact surface; and a transition portion which slopes toward the portable receiver to connect the elongated arm and the contact surface.

12. The portable receiver of claim 11, wherein the second end is circular.

13. The portable receiver of claim 12, wherein the aperture is circular.

* * * * *